US007886787B1

(12) United States Patent
Wilson

(10) Patent No.: US 7,886,787 B1
(45) Date of Patent: Feb. 15, 2011

(54) GOLF GRIP COVER

(76) Inventor: Michael A. Wilson, 33 Andiron La., Brookhaven, NY (US) 11719

( * ) Notice: Subject to any disclaimer, the term of this patent is extended or adjusted under 35 U.S.C. 154(b) by 0 days.

(21) Appl. No.: 12/283,518

(22) Filed: Sep. 12, 2008

(51) Int. Cl.
*A63B 57/00* (2006.01)
*A63B 53/00* (2006.01)

(52) U.S. Cl. ..... 150/160; 206/315.2; 473/300

(58) Field of Classification Search ..... 206/315.2; 150/155, 160; 473/298–302, 457, 409; 16/DIG. 12; 74/551.8, 551.9, 558, 558.5
See application file for complete search history.

(56) References Cited

U.S. PATENT DOCUMENTS 3,147,012 A * 9/1964 Sullivan, Jr. ..... 473/299
3,606,326 A * 9/1971 Sparks et al. ..... 473/300
4,133,529 A * 1/1979 Gambino ..... 473/298
4,662,415 A 5/1987 Proutt
4,878,667 A 11/1989 Tosti
5,118,107 A 6/1992 Bucher
5,133,395 A 7/1992 Moore
5,203,390 A 4/1993 Eckstein
5,524,885 A 6/1996 Heo
5,575,721 A 11/1996 Lilly
5,626,527 A * 5/1997 Eberlein ..... 473/203
5,701,998 A 12/1997 Perry et al.
D423,596 S 4/2000 Morrison
6,817,956 B1 * 11/2004 Dagenais ..... 473/300
2002/0175098 A1 * 11/2002 Mauch et al. ..... 206/315.3
2003/0096660 A1 * 5/2003 Ward et al. ..... 473/299
2004/0259659 A1 * 12/2004 Enlow ..... 473/300
2005/0079924 A1 * 4/2005 Heinecke ..... 473/300
2005/0137025 A1 * 6/2005 Vito et al. ..... 473/300
2007/0068612 A1 * 3/2007 Potter ..... 150/160
2007/0082749 A1 * 4/2007 Larson ..... 473/300

* cited by examiner

*Primary Examiner*—Sue A Weaver
(74) *Attorney, Agent, or Firm*—Montgomery Patent and Design; Robert C. Montgomery

(57) ABSTRACT

A cover for the grip area of golf clubs to keep them dry and protected from the elements is herein disclosed, preferably comprising a neoprene covering in the shape of a tube with the approximate dimensions of twelve (12) to twenty (20) inches long and a diameter of two (2) inches. A first end of the tube is sealed, while a second end is furnished with a flexible membrane which seals it against the club shaft. The closed end is provided with a hook to allow the cover to be hung along with a club, thereby providing a means for the cover to be placed over the grip end of a golf club in much the same manner as a sock. This not only extends the life of the club and grip, but provides the golfer with enhanced performance due to the decreased risk of slippage during play, particularly during wet conditions.

13 Claims, 3 Drawing Sheets

GOLF GRIP COVER

RELATED APPLICATIONS

The present invention was first described in official record of invention filed on Nov. 6, 2007 and incorporated by reference thereto in this application as if set forth fully herein.

FIELD OF THE INVENTION

The invention relates generally to a cover for a golf club grip and, more specifically, to such a cover that keeps golf club grips dry and free of debris, comprising a hard outer shell with a thin flexible membrane over the open end and an inner layer that removes any moisture from the golf club grip.

BACKGROUND OF THE INVENTION

The game of golf has become one of the most popular sports in the world today. As a result of such popularity, many people are joining the ranks of the playing public. Due to this popularity; manufacturers are constantly looking for new and improved golf balls, golf clubs and associated accessories to increase the enjoyment of the game and ultimately improve one's golf score. Many times, golfers play in conditions here moisture and debris may adhere to the golf club grip. This moisture or debris on the golf grip can affect the golfer's performance. Accordingly, there is a need for invention that can conveniently and effectively maintain a golf club grip in a clean and dry condition. The development of the invention herein described fulfills this need.

The present invention is a cover for the grip area of golf clubs to keep them dry and protected from the elements. The invention is to be placed over the grip end of a golf club in much the same manner as a sock. This feature keeps the grip end free of dirt, moisture and chemicals. This not only extends the life of the club and grip, but maintains a pleasant appearance and provides the golfer with enhanced performance due to the decreased risk of slippage during play. The invention is perfect for use on courses where golf carts are confined to a path as the golfer can take clubs furnished with the invention onto the playing surface and set them down on the grass without worry of damaging the grips or getting them wet. The use of the present invention allows for better golf scores by keeping golf clubs grips dry and protected in a manner which is quick, easy, and effective.

U.S. Pat. No. D423,596 issued to Morrison discloses a design patent for a golf club protective cover that appears to attach to the grip portion of a golf club by means of a hook and loop mechanism. Unfortunately, this patent does not appear to disclose an invention that is similar in appearance to the disclosed invention nor does it appear to possess an inner liner that is capable of removing moisture present on a golf grip, a thin flexible membrane over the open end of device to prevent the entry of moisture into the device, nor a clasp to attach the device to a golf bag or golf cart for convenience.

U.S. Pat. No. 5,701,998 issued to Perry and Frey discloses a baseball bat handle cover that comprises either a stiff or flexible material to cover the handle portion of the bat and a means of attaching the cover to another object. Unfortunately, this patent does not appear to disclose a golf grip cover that is attachable to a golf bag or golf cart and that possesses an inner liner capable of removing moisture from a golf club. Nor does the disclosed patent appear to disclose a thin flexible membrane with an aperture that prohibits the entry of moisture into the inner cavity of the device.

U.S. Pat. No. 5,575,721 issued to Lilly discloses a golf grip sleeve device that permits the use of the golf club while the sleeve device is in place. Unfortunately, this patent does not appear to disclose, inter alia, a golf grip cover that contains an outer shell nor does it appear to disclose a cover for a golf club when the club is not in use.

U.S. Pat. No. 5,524,885 issued to Heo discloses a terry cloth golf club grip that appears to be a slip on grip comprising a thin rubber tube with an outer fabric layer. Unfortunately, this patent does not appear to disclose a golf grip cover that possesses an inner liner capable of removing moisture from a golf club, nor does it appear to possess a thin flexible membrane with an aperture to prevent the entry of moisture into the inner cavity of the device.

U.S. Pat. No. 5,203,390 issued to Eckstein describes a cover for protecting golf club handles that appears to be a tubular member comprising an outer shell and a fabric inner liner with a drawstring closure mechanism. Unfortunately, this patent does not disclose a golf grip cover with a thin flexible membrane with an aperture to prevent the entry of moisture nor does the disclosed patent appear to possess a clasp for convenience.

U.S. Pat. No. 5,133,395 issued to Moore discloses a golf club protector that appears to be a hollow sleeve that covers substantially the entire golf club. Unfortunately, this patent does not appear to disclose a golf grip cover that covers only the grip portion of a golf club and that possesses a hard outer shell and an inner liner that removes moisture from the golf club grip. Nor does the disclosed patent appear to possess a clasp mechanism or a thin flexible membrane to prevent the entry of moisture into the inner cavity.

U.S. Pat. No. 5,118,107 issued to Bucher discloses a rain cover for golf club handle that comprises a porous fibrous material with a zippered closure. Unfortunately, this patent does not appear to disclose a golf grip cover that covers only the grip portion of a golf club and that possesses a hard outer shell and an inner liner that removes moisture from the golf club grip. Nor does the disclosed patent appear to possess a clasp mechanism or a thin flexible membrane to prevent the entry of moisture into the inner cavity.

U.S. Pat. No. 4,878,667 issued to Tosti discloses a replaceable, reusable golf club grip that appears to be a grip that can be quickly dissembled from the shaft of a golf club. Unfortunately, this patent does not appear to disclose a golf grip cover that is attachable to a golf bag or golf cart and that possesses an inner liner capable of removing moisture from a golf club. Nor does the disclosed patent appear to disclose a thin flexible membrane with an aperture that prohibits the entry of moisture into the inner cavity of the device.

U.S. Pat. No. 4,662,415 issued to Proutt discloses a cover for a golf club handle with an outer sheath of water resistant material with a flap closure means. Unfortunately, this patent does not appear to disclose a golf grip cover that covers only the grip portion of a golf club and that possesses a hard outer shell and an inner liner that removes moisture from the golf club grip. Nor does the disclosed patent appear to possess a clasp mechanism or a thin flexible membrane to prevent the entry of moisture into the inner cavity.

SUMMARY OF THE INVENTION

In view of the foregoing disadvantages inherent in the prior art, it has been observed that there is need for a golf club grip cover which provides a means for keeping a grip surface of a golf club dry and protected from the elements.

An object of the golf grip cover generally comprises a tubular body approximately ten (10) to twelve (12) inches long and approximately one-and-one-half (1½) to two (2) inches in diameter.

Another object of the golf grip cover is one (1) end of the tubular body is sealed and one (1) end is open which allows for the insertion of the grip portion of the golf club in a manner similar to a sock.

A further object of the golf grip cover is that the device is portable and easy to carry.

Yet another object of the golf grip cover is that the device increases the life of the club grip and reduces the possibility of grip slippage when a user engages said club.

Still another object of the golf grip cover provides for a thin flexible rubber membrane with an aperture on the open end of the device thereby providing a means of wiping the grip of a golf club when inserted and sealing the internal cavity of the device from the elements.

Yet still another object of the golf grip cover is to accommodate a variety of sizes of golf clubs.

Still a further object of the golf grip cover is to provide an outer shell that is provided in a variety of decorative designs and colors.

Another object of the golf grip cover is to provide an inner liner that removes moisture from the grip portion of the golf club when inserted into the internal cavity.

An aspect of the golf grip cover comprises an outer shell, clasp, loop, support ring, a rubber membrane with an aperture and an inner lining.

A further aspect of the golf grip cover comprises an outer shell which is made of a water-proof fabric such as neoprene or other like synthetic rubber compound and is fabricated through common textile manufacturing processes. The outer shell forms the outer lining and exterior body of the golf grip cover.

Another aspect of the golf grip cover comprises a clasp which is located on an outside surface of the closed-end of said device and is envisioned as a manually spring hook, latch, or the like. The clasp provides a means of removably attaching the device to a golf bag or golf cart. The clasp is attached via a loop envisioned as a "D"-ring, fabric loop, or the like which is permanently attached thereto the closed-end of said device.

A further aspect of the golf grip cover comprises a support ring located on the open-end of said device which provides a means of gripping support for a user when a golf club is inserted. The support ring is approximately two-and-one-half (2½) inches long and of a diameter equivalent to the diameter of the tubular outer shell preferably made of a light weight rigid plastic or the like.

Still a further aspect of the golf grip cover comprises a thin flexible rubber membrane. The membrane comprises an aperture which is smaller in diameter than the diameter of the grip-end of a golf club.

Still another aspect of the golf grip cover comprises a plurality of layers consisting of the outer shell, the support ring, and an inner lining. The inner lining extends the length of the device and is preferably made of a water-absorbent chamois-like material. The inner lining attaches to an inside surface of the outer shell.

A method of utilizing the golf grip cover may be achieved by performing the following steps: retrieving the device from a stored location when inclement weather begins; gripping the device by the support ring; retrieving a golf club that a user wishes to insert therein said device; inserting the grip portion of the golf club through the aperture; stretching the aperture to the size of the outer shaft diameter of the golf club; discontinuing insertion of the golf club at the point where the grip portion is completely within the internal cavity; drying the grip portion of the golf club through contact with the inner lining; protecting the grip portion of the golf club from the elements via the outer shell and rubber membrane; removing the golf club as needed for play; reattaching and detaching the clasp of said device to the golf bag as needed; and, enjoying the benefits of playing golf with golf clubs with dry grips due to the use of the golf grip cover.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | golf grip cover |
| 20 | outer shell |
| 22 | support ring |
| 24 | inner lining |
| 30 | clasp |
| 32 | loop |
| 40 | membrane |
| 42 | aperture |
| 50 | internal cavity |
| 100 | golf club |

DETAILED DESCRIPTION OF THE PREFERRED EMBODIMENT

Figure 1:
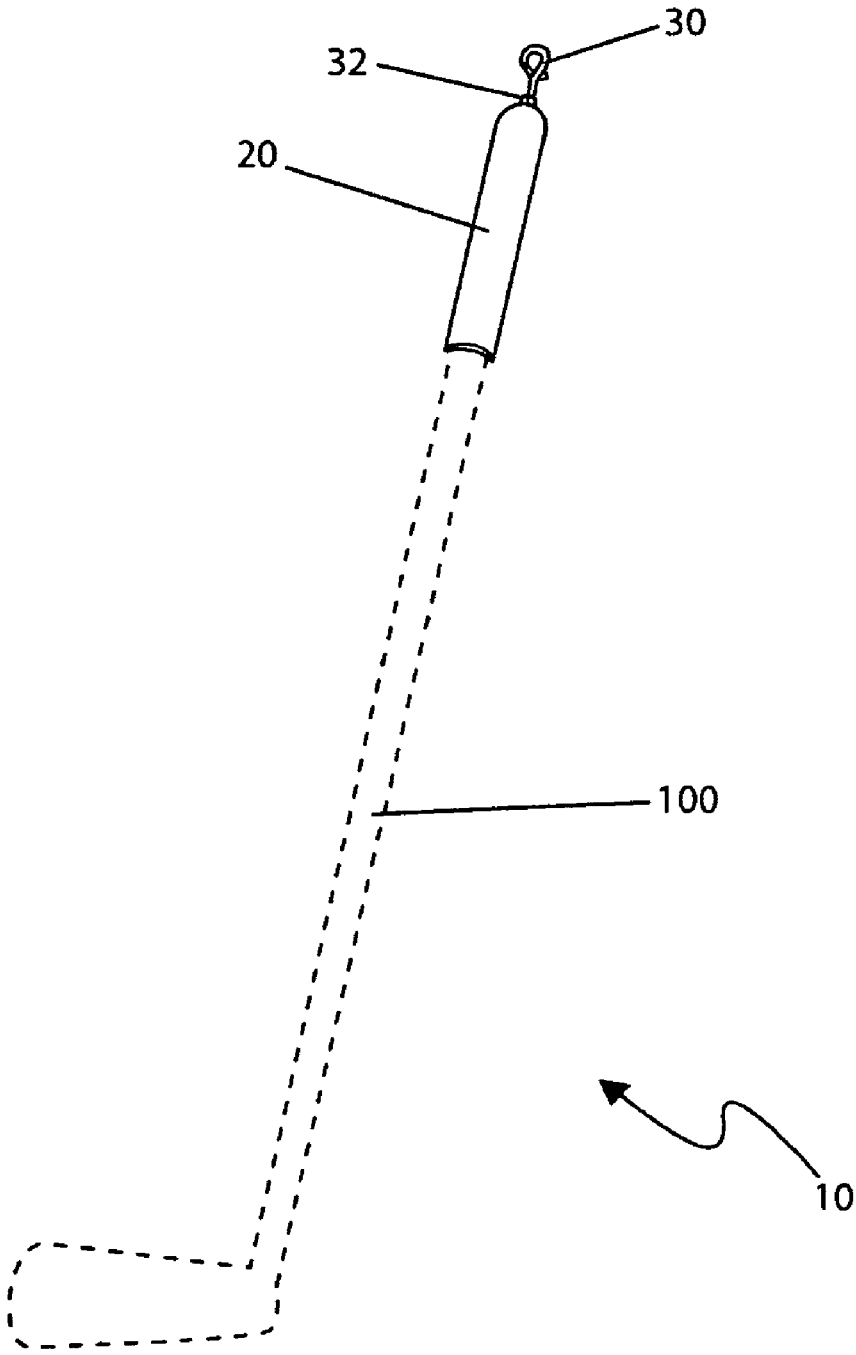
FIG. 1 is an environmental view of a golf grip cover 10, according to a preferred embodiment of the present invention.
Figure 2:
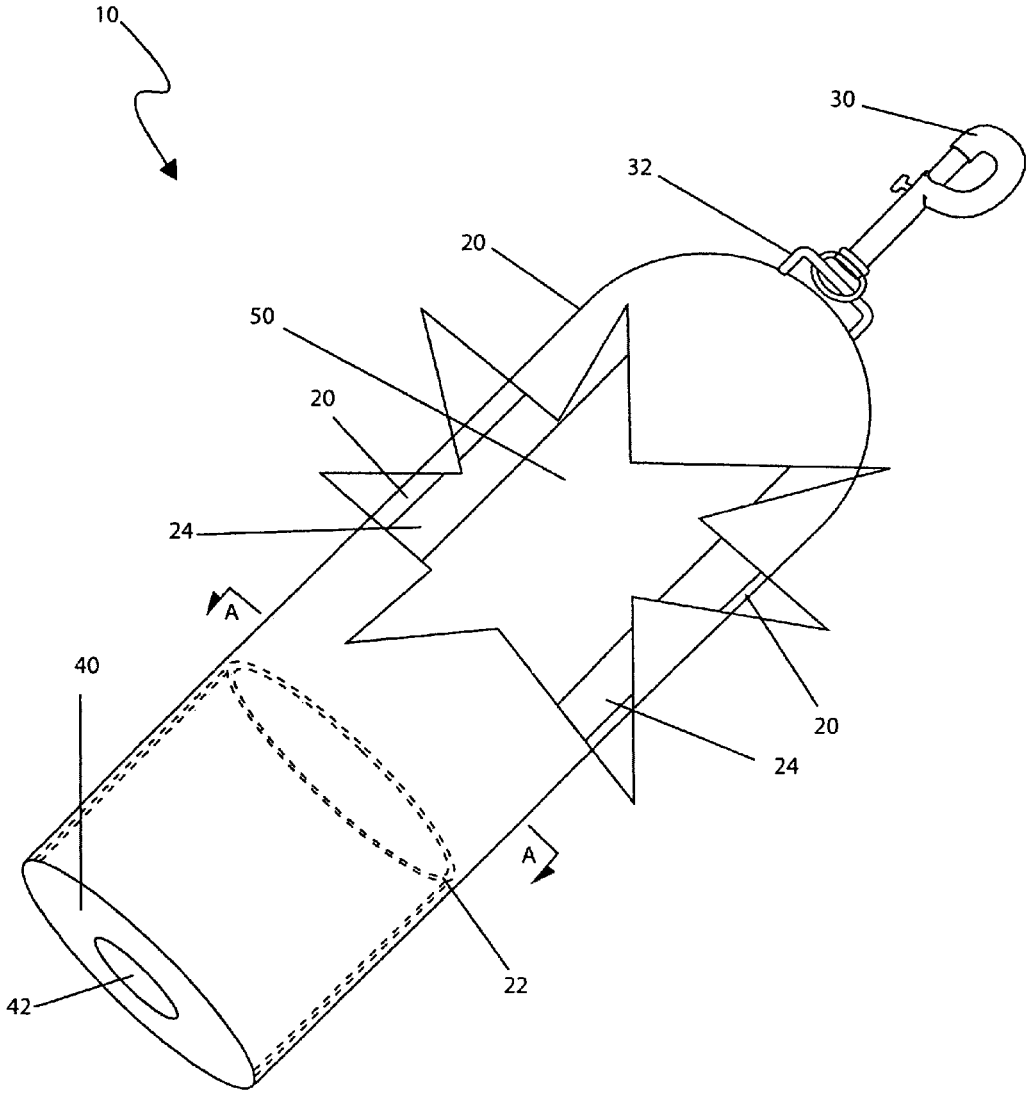
FIG. 2 is a perspective view of a golf grip cover 10, according to a preferred embodiment of the present invention; and, FIG. 3 is a section view taken along section line A-A (see FIG. 2) of a golf grip cover 10, according to a preferred embodiment of the present invention.
Figure 3:
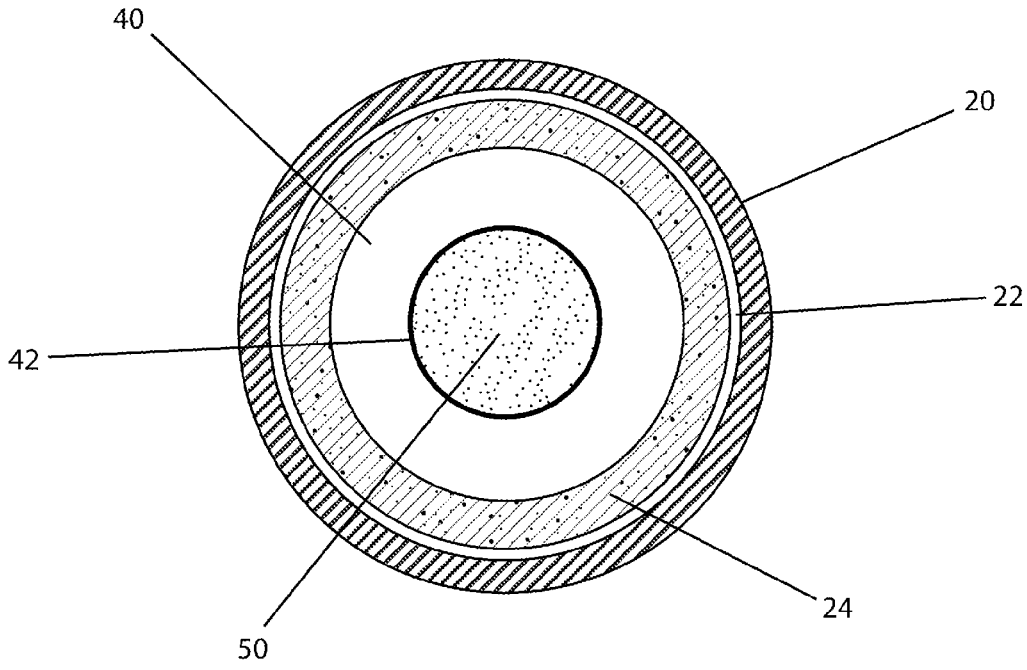

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a golf grip cover (herein described as the "device") 10, which provides a means for keeping a grip surface of a golf club 100 dry and protected from the weather. The device 10 generally comprises a tubular body approximately ten (10) to twelve (12) inches long and approximately one-and-one-half (1½) to two (2) inches in diameter. One (1) end of the tubular body is sealed and one (1) end is open which allows for the insertion of the grip portion of the golf club 100 in a manner similar to a sock. The device 10 is portable and increases the life of the club 100 grip and reduces the possibility of grip-slippage when a user engages said club 100.

Referring now to FIG. 1, an environmental view of the device 10, according to the preferred embodiment of the present invention, is disclosed. The device 10 comprises an outer shell 20 which is preferably made of a water-proof fabric such as neoprene or other like synthetic rubber compounds and is fabricated through common textile manufacturing processes. The outer shell 20 forms the outer lining and exterior body of the device 10. The device 10 also comprises a clasp 30 which is located on an outside surface of the closed-end of said device 10 and is envisioned as a manually spring hook, latch, or the like. The clasp 30 provides a means of removably attaching the device 10 thereto a golf bag or golf cart by engaging said clasp 30 therearound said bag. The clasp 30 is attached to the device 10 via a loop 32 envisioned as a "D"-ring, fabric loop, or the like which is permanently attached thereto the closed-end of said device 10.

Referring now to FIG. 2, a perspective view of the device 10, according to the preferred embodiment of the present invention, is disclosed. The device 10 comprises a support ring 22 located thereon the open-end of said device 10 which provides a means of gripping support for a user when a golf club 100 is inserted thereinto said device 10. The support ring is approximately two-and-one-half (2½) inches long and of a diameter equivalent to the diameter of the tubular outer shell 20 preferably made of a light weight rigid plastic or the like. The device 10 also comprises a thin flexible rubber membrane 40 which is stretched thereover the outside of the open-end of said device 10. The membrane 40 comprises an aperture 42 which is smaller in diameter than the diameter of the grip-end of a golf club 100 thereby stretching therearound the shaft of the club 100 when inserted and is attached by adhesives or the like thereto the outer shell 20. The membrane 40 and aperture 42 combine to provide a means of wiping the grip of a golf club 100 when inserted and sealing the internal cavity 50 of the device 10 from the outside-elements.

Referring now to FIG. 3, a section view taken along section line A-A of the device 10, according to the preferred embodiment of the present invention, is disclosed. The device 10 comprises a plurality of layers consisting of the outer shell 20, the support ring 22, and an inner lining 24. The inner lining 24 extends the length of the device 10 and is preferably made of a water-absorbent chamois-like material forming the inner surface of said device 10. The inner lining 24 is envisioned to remove moisture from the grip portion of the golf club 100 when inserted therein the internal cavity 50 of the device 10. The inner lining 24 attaches thereto an inside surface of the outer shell 20 via stitching, adhesives, or similar common textile attachment means.

The device 10 is envisioned to accommodate a variety of sizes of golf clubs 100. The device 10 is also envisioned to be introduced comprising an outer shell 20 in a variety of decorative designs and colors.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIGS. 1 through 3.

The method of utilizing the device 10 may be achieved by performing the following steps: retrieving the device 10 therefrom a stored location when inclement weather begins; detaching the clasp 30 therefrom a golf bag; gripping the device 10 by the support ring 22 portion; retrieving a golf club 100 that a user wishes to keep dry; inserting the grip portion of the golf club 100 therethrough the aperture 42; stretching the aperture 42 to the size of the outer shaft diameter of the golf club 100; discontinuing insertion of the golf club 100 at the point where the grip portion is completely therein the internal cavity 50 of device 10; drying the grip portion of the golf club 100 by making contact therewith the inner lining 24; protecting the grip portion of the golf club 100 from the elements via the outer shell 20 and rubber membrane 40; removing the golf club 100 therefrom the device 10 when needed for play; reattaching the clasp 30 thereto the golf bag; and, playing golf as normal.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A golf grip cover device, comprising:

a tubular body comprising a closed end, an open end opposite said closed end, and an internal cavity formed therein, further comprising:

an outer shell forming an outer surface of said tubular body; and, an inner lining forming an inner surface of said tubular body;

a clasp attached thereto an outside surface of said closed end of said device by a loop piece, thereby providing a means of removably attaching said device thereto a support structure;

a support ring located therein said open end; and, a membrane located thereover an outside surface of said open end comprising an aperture;

wherein said inner lining removes moisture from said grip portion of said golf club when said golf club is inserted therein said internal cavity of said device;

wherein said open end allows for insertion of a grip portion of a golf club therein said internal cavity;

wherein said support ring provides a means of gripping support for a user when said grip portion of said golf club is inserted thereinto said device;

wherein said support ring is approximately two-and-one-half (2½) inches long and approximately one-and-one-half (1½) to two (2) inches in diameter;

wherein said aperture of said membrane stretches therearound a shaft portion of said golf club when said golf club is inserted therein said device; and, wherein said membrane and said aperture provide a means of wiping said grip portion of said golf club and sealing said device thereover said golf club, thereby preventing debris from entering therein.

2. The device of claim 1, wherein said outer shell comprises a water-proof fabric.

3. The device of claim 2, wherein said outer shell comprises neoprene.

4. The device of claim 1, wherein said inner lining comprises a water-absorbent material.

5. The device of claim 4, wherein said inner lining comprises chamois.

6. The device of claim 1, wherein said support ring comprises a rigid plastic.

7. The device of claim 1, wherein said membrane comprises a rubber material.

8. The device of claim 1, wherein said tubular body is approximately ten (10) to twelve (12) inches long.

9. The device of claim 1, wherein said tubular body is approximately one-and-one-half (1½) to two (2) inches in diameter.

10. The device of claim 1, wherein said support structure is a golf cart or a golf bag.

11. The device of claim 1, wherein said device accommodates a variety of sizes of golf clubs.

12. The device of claim 1, wherein said device comprises a variety of decorative designs.

13. A golf grip cover device for a golf club, comprising:

a tubular body comprising a closed end, an open end opposite said closed end, and an internal cavity formed therein, further comprising:

a neoprene outer shell forming an outer surface of said tubular body; and, a chamois inner lining forming an inner surface of said tubular body;

a clasp attached thereto an outside surface of said closed end of said device thereby providing a means of removably attaching said device thereto a support structure;

a support ring located therein said open end; and, a membrane located thereover an outside surface of said open end comprising an aperture;

wherein said tubular body is approximately ten (10) to twelve (12) inches long and approximately one-and-one-half (1½) to two (2) inches in diameter;

wherein said open end allows for insertion of a grip portion of said golf club therein said internal cavity;

wherein said support ring provides a means of gripping support for a user when said grip portion of said golf club is inserted thereinto said device;

wherein said support ring is approximately two-and-one-half (2½) inches long and approximately one-and-one-half (1½) to two (2) inches in diameter;

wherein said aperture of said membrane stretches therearound a shaft portion of said golf club when said golf club is inserted therein said device;

wherein said membrane and said aperture provide a means of wiping said grip portion of said golf club and sealing said device thereover said golf club, thereby preventing debris from entering therein; and, wherein said inner lining removes moisture from said grip portion of said golf club when said golf club is inserted therein said internal cavity of said device.

* * * * *